US006945664B1

(12) United States Patent
Frieling et al.

(10) Patent No.: US 6,945,664 B1
(45) Date of Patent: Sep. 20, 2005

(54) LIGHT SIGNAL BY INVERTING

(76) Inventors: Edward Frieling, 17656 Foxwood Way, Boca Raton, FL (US) 33487; Sherrie Frieling, 17656 Foxwood Way, Boca Raton, FL (US) 33487

( * ) Notice: Subject to any disclaimer, the term of this patent is extended or adjusted under 35 U.S.C. 154(b) by 0 days.

(21) Appl. No.: 10/869,300

(22) Filed: Jun. 16, 2004

(51) Int. Cl.[7] ..... F21V 33/00; F21V 23/04
(52) U.S. Cl. ..... 362/101; 362/253; 362/394
(58) Field of Search ..... 362/96, 101, 234, 362/253, 394

(56) References Cited

U.S. PATENT DOCUMENTS 2,663,866 A * 12/1953 Simpson ..... 362/101
4,390,928 A * 6/1983 Runge ..... 362/101
5,436,417 A 7/1995 Dault
5,444,437 A 8/1995 Layher
5,463,537 A 10/1995 Trattner
5,662,406 A * 9/1997 Mattice et al. ..... 362/101
5,990,790 A * 11/1999 Lusareta ..... 362/101
6,005,204 A * 12/1999 Choi et al. ..... 362/101
6,690,457 B2 2/2004 Yamaguchi
6,793,362 B2 * 9/2004 Tai ..... 362/101
6,793,363 B2 * 9/2004 Jensen ..... 362/101
2003/0090892 A1 * 5/2003 Su ..... 362/101

* cited by examiner

*Primary Examiner*—Alan Cariaso
(74) *Attorney, Agent, or Firm*—Alvin S. Blum

(57) ABSTRACT

A simple, inoffensive, and economic device is provided for signaling to get the attention of a waiter or waitress in a restaurant. A housing having a flat top and bottom holds one or more light emitters, preferably a number of light emitting diodes. A battery in the housing powers the lights through a gravity actuated switch and an intermittent flashing circuit. One flat face of the device is attached to the bottom of a can or bottle. When upright, the container rests on the device, and the lights are off. When the container is inverted to signal for service, the switch powers the emitters, which flash intermittently. The device may include a mechanism to stabilize the container in the inverted position.

16 Claims, 2 Drawing Sheets

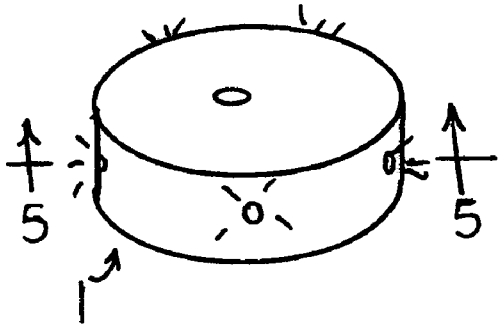
FIG.4
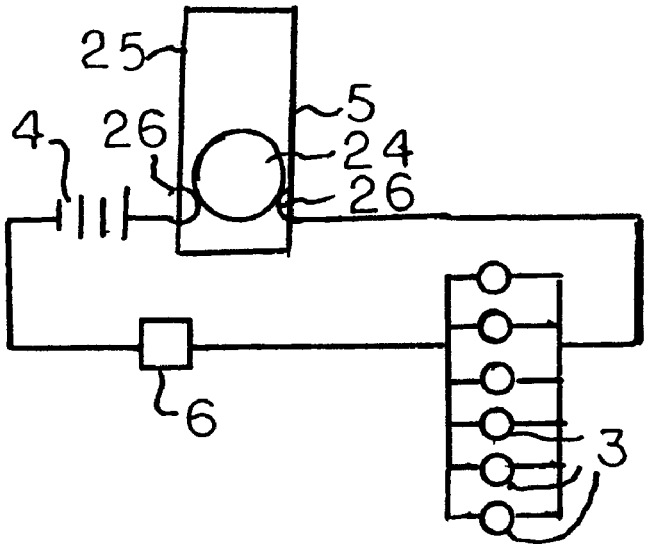
FIG. 3
FIG. 1
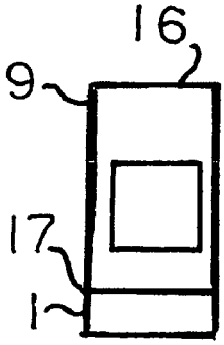
FIG. 2
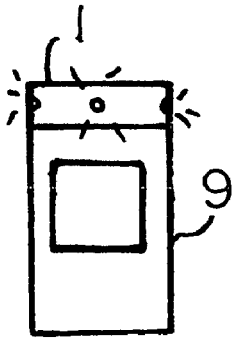

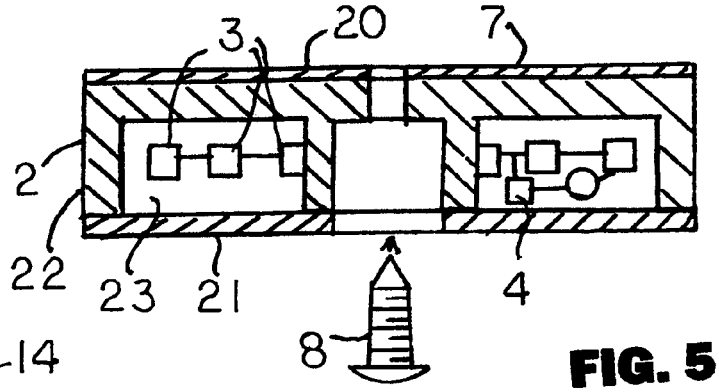
FIG. 5
FIG. 7
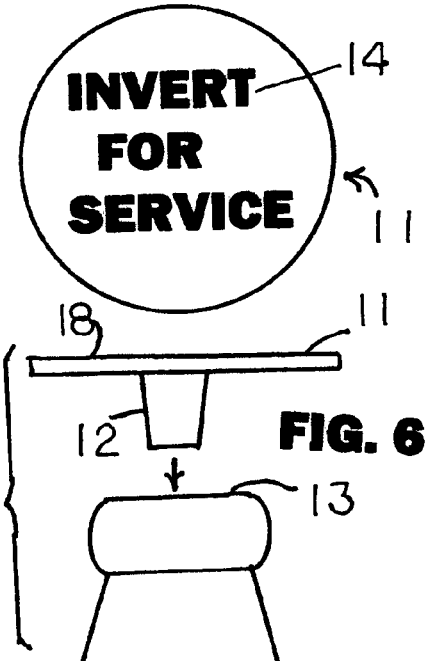
FIG. 6
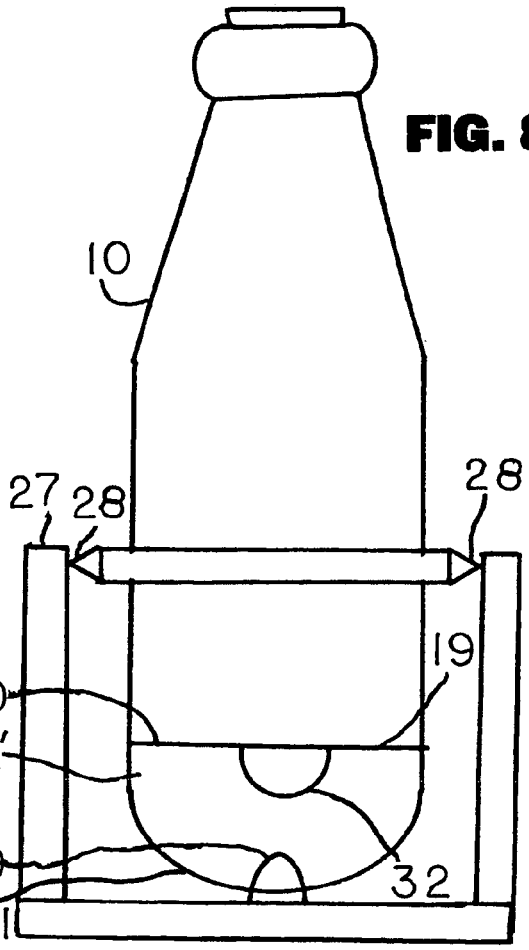
FIG. 8

LIGHT SIGNAL BY INVERTING

This invention relates to electric signals and more particularly to devices directed to signaling for service at a restaurant or bar.

BACKGROUND OF THE INVENTION

When seated at a table, a patron waiting for service such as to order another drink, or to request a check, often has difficulty in catching the attention of the waiter or waitress. In China, one signals that the teapot is empty by opening the lid. It is customary in some places to signal for another bottle of wine or beer by inverting the bottle. These methods are not always effective in getting the attention of busy or inattentive staff. Keeping impatient diners waiting loses customers and keeps tables needlessly occupied. A method for more effectively getting the attention of the wait staff will enhance the business of the restaurant.

SUMMARY OF THE INVENTION

It is accordingly an object of the invention to provide a simple, inoffensive, and economic device for getting the attention of the wait staff. It is another object that the device be easily operated. It is yet another object that the device be operable by a technique familiar to many patrons. It is yet another object that the device is acceptable to beverage vendors as a means of advertising their product. The device of the invention comprises one or more battery operated light emitters that are gravity actuated. The device is attached to the bottom of a bottle, glass, mug, or can. The light[s] turn on when the bottle, mug, glass, or can is inverted, thereby signaling to the wait staff. To enhance the signal and reduce the battery load, the light[s] flash on intermittently. The light control may include means to turn off the lights after a preset time interval. This will conserve battery, especially in shipping the product to market. These and other objects, features, and advantages of the invention will become more apparent when the detailed description is studied in conjunction with the drawings in which like elements are designated by like reference characters in the various drawing figures.

BRIEF DESCRIPTION OF THE DRAWINGS

FIG. 1 is a front elevation view of the device on a can in the inactive position.

FIG. 2 is a front elevation as in FIG. 1 with the can inverted to call for service.

FIG. 3 is schematic diagram of the circuit of the invention.

FIG. 4 is a perspective view of the device unattached to a container.

FIG. 5 is a sectional view through line 5—5 of FIG. 4.

FIG. 6 is a front elevation view of the device attached to a bottle.

FIG. 7 is a top view of the device in FIG. 6.

FIG. 8 is a front elevation view of another embodiment of the invention.

DETAILED DESCRIPTION OF PREFERRED EMBODIMENTS

Referring now to the drawing FIGS. 1–5, the device 1 of the invention comprises a housing 2 having a flat top 20, a flat bottom 21 and a cylindrical side portion 22. The bottom is removable for replacing the battery 4. The top 20 may be provided with adhesive attaching means 7 for affixing to the bottom 17 of an empty beverage container, such as the beer can 9 shown here. The top 16 of the can may be provided with a label (not shown) displaying a legend such as, for example, "invert for service". The device may also be attached by other means such as the screw 8. The housing 2 may be made of a clear or frosted plastic with the annular space 23 adapted for receiving the electronic circuitry comprising the light emitters 3 disposed around the circumference to shine out through the cylindrical wall 22 at spaced apart intervals. The one lead of the battery 4 is connected through a flashing control circuit 6 well known in the art to a plurality of light emitters 3, such as light emitting diodes. Alternatively, a single flashing light (not shown) may be provided. The control circuit 6 may also be provided with means to turn off the one or more emitters 3 after a preset time interval. The other lead from the battery connects to the emitters through a gravity activated switch 5 such as those well known in the art. The switch 5 shown here has a steel ball 24 captive in a non-conductive tube 25. Two spaced-apart conductors 26 enter the tube at one end. In one position shown in FIG. 3, the ball is resting on both the conductors 26, thereby completing the circuit and causing the emitters to flash intermittently and/or in sequence. This is the call for service position the device will have when the container is inverted. When the switch is inverted (not shown), the ball 24 moves away from the conductors 26 and the lights are out.

Referring now to the drawing FIGS. 6 and 7, a bottle 10 is shown with the device 1 affixed to its bottom 19. A stabilizer 11 is provided for the top 13 of the bottle with a plug 12 to insert into the top of the bottle. Attached to the plug is a flat plate 18 large enough to keep the bottle from falling over when it is placed in the inverted position. A legend 14 on the plate may be provided for instructional purposes. An advertising label 15 may also be provided on the container to enhance its economic value.

Referring now to FIG. 8 a container holder 27 may be provided that holds the bottle 10 with two pivots 28 so that the bottle is stable in upright and inverted position with spring detents 29. Alternatively, the bottle may be partially filled with fluent material whose weight will shift when the bottle is inverted to take the place of the detents. The housing 2' of the invention in this embodiment has a flat face 30 applied to the bottom 19 of the bottle 10 and an opposed domed face 31 containing a single, centrally located light emitter 32.

While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A signal device for use with a beverage container, the beverage container having a bottom and a top, the device comprising:

a) a housing;

b) at least one light emitter affixed to the housing;

c) an electric battery;

d) a gravity actuated switch;

e) control means for connecting the battery to the at least one light emitter through the switch such that the at least one light emitter is intermittently activated when the housing is in a first orientation, and inactivated in a second orientation; and f) attaching means for attaching the housing to the bottom of the container so that the housing is in the second orientation when the container is upright, and the housing is in the first orientation with the at least one light emitter intermittently flashing light when the container is inverted to thereby signal for attention;

g) stabilizing means attachable to the container for maintaining the container in the inverted position; and in which the stabilizing means comprises a wide fixture attachable to the top of the container.

2. The device according to claim 1 in which the at least one light emitter comprises a plurality of light emitting diodes.

3. The device according to claim 1 further comprising control means for turning off the intermittently activated at least one light emitter after a preset time interval.

4. A signal device for use with a beverage container, the beverage container having a bottom and a top, the device comprising:

a) a housing;

b) at least one light emitter affixed to the housing;

c) an electric battery;

d) a gravity actuated switch;

e) control means for connecting the battery to the at least one light emitter through the switch such that the at least one light emitter is intermittently activated when the housing is in a first orientation, and inactivated in a second orientation; and f) attaching means for attaching the housing to the bottom of the container so that the housing is in the second orientation when the container is upright, and the housing is in the first orientation with the at least one light emitter intermittently flashing light when the container is inverted to thereby signal for attention;

g) stabilizing means attachable to the container for maintaining the container in the inverted position; and in which the stabilizing means comprises a stand with a pivot mechanism that enables the container to pivot on the pivot mechanism about a transverse axis disposed intermediate the top and bottom, including a detent mechanism to stabilize the upright and inverted orientations of the container.

5. The device according to claim 4 in which the at least one light emitter comprises a plurality of light emitting diodes.

6. The device according to claim 4 further comprising control means for turning off the flashing at least one light emitter after a preset time interval.

7. The device according to claim 4 in which the at least one light emitter comprises a plurality of light emitting diodes.

8. The device according to claim 4 further comprising control means for turning off the intermittently activated at least one light emitter after a preset time interval.

9. A signal device for use with a beverage bottle, the beverage bottle having a bottom and a top, the device comprising:

a) a housing;

b) at least one light emitter affixed to the housing;

c) an electric battery;

d) a gravity actuated switch;

e) control means for connecting the battery to the at least one light emitter through the switch such that the at least one light emitter is intermittently activated when the housing is in a first orientation, and inactivated in a second orientation; and f) attaching means for attaching the housing to the bottom of the container so that the housing is in the second orientation when the container is upright, and the housing is in the first orientation with the at least one light emitter intermittently flashing light when the container is inverted to thereby signal for attention;

g) stabilizing means attachable to the container for maintaining the container in the inverted position; and in which the stabilizing means includes a plug to fit into the top of the bottle.

10. The device according to claim 9 in which the at least one light emitter comprises a plurality of light emitting diodes.

11. The device according to claim 9 in which the at least one light emitter comprises a plurality of light emitting diodes.

12. The device according to claim 9 further comprising control means for turning off the intermittently activated at least one light emitter after a preset time interval.

13. A signal device for use with a beverage container, the beverage container having a bottom and a top, the device comprising:

a) a housing;

b) at least one light emitter affixed to the housing;

c) an electric battery;

d) a gravity actuated switch;

e) control means for connecting the battery to the at least one light emitter through the switch such that the at least one light emitter is intermittently activated when the housing is in a first orientation, and inactivated in a second orientation; and f) attaching means for attaching the housing to the bottom of the container so that the housing is in the second orientation when the container is upright, and the housing is in the first orientation with the at least one light emitter intermittently flashing light when the container is inverted to thereby signal for attention;

g) stabilizing means attachable to the container for maintaining the container in the inverted position; and in which the stabilizing means comprises a stand with a pivot mechanism that enables the container to pivot on the pivot mechanism about a transverse axis disposed intermediate the top and bottom, including the stabilizing means comprises fluent material partially filling the bottle.

14. The device according to claim 13 in which the at least one light emitter is a single light emitter centrally located in a domed enclosure.

15. The device according to claim 13 in which the at least one light emitter comprises a plurality of light emitting diodes.

16. The device according to claim 13 further comprising control means for turning off the intermittently activated at least one light emitter after a preset time interval.

* * * * *